US008025247B2

(12) United States Patent
Dallimore et al.

(10) Patent No.: US 8,025,247 B2
(45) Date of Patent: Sep. 27, 2011

(54) DISTRIBUTOR PLATE FOR A VSI-CRUSHER, AND A METHOD OF REPLACING SUCH A PLATE

(75) Inventors: Rowan Dallimore, Bath (GB); George Fensome, Bristol (GB); Knut Kjaerran, Svedala (SE)

(73) Assignee: Sandvik Intellectual Property AB, Sandviken (SE)

( * ) Notice: Subject to any disclaimer, the term of this patent is extended or adjusted under 35 U.S.C. 154(b) by 557 days.

(21) Appl. No.: 12/153,998

(22) Filed: May 28, 2008

(65) Prior Publication Data

US 2008/0296418 A1 Dec. 4, 2008

(30) Foreign Application Priority Data

May 30, 2007 (SE) ..... 0701292

(51) Int. Cl.
*B02C 1/10* (2006.01)
*B02C 1/12* (2006.01)
*B02C 23/02* (2006.01)

(52) U.S. Cl. ..... 241/275; 241/300

(58) Field of Classification Search ..... 241/275, 241/300

See application file for complete search history.

(56) References Cited

U.S. PATENT DOCUMENTS

| | | | | |
|---|---|---|---|---|
| 3,138,337 | A * | 6/1964 | Bogot et al. | 241/103 |
| 3,193,206 | A * | 7/1965 | Bidwell | 241/282.1 |
| 4,126,280 | A * | 11/1978 | Burk | 241/275 |
| 4,690,341 | A | 9/1987 | Hise et al. | |
| 5,497,951 | A * | 3/1996 | Watajima | 241/300 |
| 7,451,944 | B2 * | 11/2008 | Hall et al. | 241/207 |
| 2006/0011762 | A1 * | 1/2006 | Dallimore et al. | 241/275 |

FOREIGN PATENT DOCUMENTS

| | | |
|---|---|---|
| WO | 01/30501 A1 | 5/2001 |
| WO | WO 2004/020100 | 3/2004 |
| WO | 2004/037424 A1 | 5/2004 |

OTHER PUBLICATIONS

International Search Report mailed Sep. 2, 2008 issued in PCT Application No. PCT/SE2008/000207.

* cited by examiner

*Primary Examiner* — Bena Miller
(74) *Attorney, Agent, or Firm* — Drinker Biddle & Reath LLP

(57) ABSTRACT

A replaceable distributor plate is adapted for protecting a lower horizontal disc of a rotor of a vertical shaft impact crusher. The replaceable distributor plate includes at least two separate pieces. The separate pieces are separated from each other along separating lines, as seen from above, each of which separating lines extend substantially from the center of the distributor plate to the periphery thereof.

8 Claims, 8 Drawing Sheets

VIb-VIb

VIIb-VIIb

DISTRIBUTOR PLATE FOR A VSI-CRUSHER, AND A METHOD OF REPLACING SUCH A PLATE

CROSS-REFERENCE TO PRIOR APPLICATION

This application claims priority to Swedish Application No. 0701292-5 filed May 30, 2007, which is incorporated by reference herein.

FIELD OF THE INVENTION

The present invention relates to a replaceable distributor plate adapted for protecting a lower horizontal disc of a rotor of a vertical shaft impact crusher. The present invention also relates to a method of mounting a replaceable distributor plate on a lower horizontal disc of a rotor of a vertical shaft impact crusher for protecting the lower horizontal disc.

BACKGROUND OF THE INVENTION

Vertical shaft impact crushers (VSI-crushers) are used in many applications for crushing hard material, such as rocks, ore, etc. U.S. Pat. No. 4,690,341 describes one example of such a VSI-crusher. A VSI-crusher comprises a housing and a horizontal rotor located inside the housing. Material that is to be crushed is fed into the rotor via an opening in the top thereof. With the aid of centrifugal force, the rotating rotor ejects the material against the wall of the housing. On impact with the wall of the housing, the material is crushed to a desired size. The housing wall could be provided with anvils or have a bed of retained material against which the accelerated material is crushed.

The rotor of a VSI-crusher usually has a horizontal upper disc and a horizontal lower disc. The upper and lower discs are connected with a vertical rotor wall. The upper disc has an aperture for feeding material into the rotor. The material lands on the lower disc and is then thrown out of the rotor via openings in the rotor wall. A replaceable center distributor plate is mounted on the horizontal lower disc to protect the same from the material fed to the rotor. The horizontal lower disc of U.S. Pat. No. 4,690,341 is protected by a replaceable circular center distributor plate. WO 2004/020101 illustrates a replaceable hexagonal center distributor plate, which has been found to provide a longer life than the circular ones.

When the center distributor plate has been worn out, it must be replaced, a task which includes a complicated maintenance procedure.

SUMMARY

It is an object of the present invention to provide a replaceable distributor plate of a rotor of a VSI-crusher, the distributor plate being adapted for decreasing the average effort spent on maintaining the VSI-crusher.

This object is achieved with a replaceable distributor plate adapted for protecting a lower horizontal disc of a rotor of a vertical shaft impact crusher, the distributor plate including at least two separate pieces, the at least two separate pieces being separated from each other along separating lines, as seen from above, each of which separating lines extending substantially from the center of the distributor plate to the periphery thereof.

An advantage of this distributor plate is that it decreases the effort required when replacing it, because each of the separate pieces has a lower weight than the distributor plate formed from such separate pieces. Thus, the health and safety implications on operating and maintenance personnel is reduced. A further advantage is that the need to dismantle parts of the crusher is reduced, since the separate pieces are smaller in size than a complete distributor plate, and may, for that reason, be taken out of smaller openings in the crusher. Still further, the distributor plate, comprising the separate pieces, has a longer life than the distributor plates of the prior art. A possible explanation is that the separate pieces, being smaller than a complete distributor plate, cool more rapidly after the casting process, such that hardness is improved. Furthermore, the shrinkage during the casting process, which may cause a formation of holes inside the cast object, is reduced by the separate pieces, being smaller than the complete distributor plate.

According to one preferred embodiment, all of the at least two separate pieces have substantially the same size. An advantage of this embodiment is that all of the separate pieces have substantially the same, low, weight and are equally easy to handle. Furthermore, all of the separate pieces can be removed via the same openings in the rotor and/or the crusher. According to a still more preferred embodiment, all of the separate pieces have exactly the same design. In such an embodiment, only one type of separate piece is required. This reduces the cost for manufacturing and stock-keeping, since one type of separate piece can be used in all positions of the distributor plate.

Preferably, the distributor plate comprises 3 to 6 separate pieces. An advantage of this embodiment is that each separate piece will be quite light, in comparison to the entire distributor plate, without causing increased mounting times because of too many separate pieces having to be assembled.

Preferably, each of the at least two separate pieces comprises, at its lower face, a first portion of a projection-opening arrangement, the first portion being adapted for cooperating with a second portion of the projection-opening arrangement, the second portion being associated with the lower horizontal disc. Such a design provides for a secure fastening of each of the separate pieces, such that the integrity of the distributor plate is not jeopardized.

According to one embodiment, each of the at least two separate pieces comprises, adjacent to the center of the distributor plate, a notch adapted for cooperating with a bracket fixing the central portion of the distributor plate to the lower horizontal disc. The notch makes it possible to secure the separate piece at the center of the distributor plate, without any through bolts extending there through.

Preferably, the distributor plate has a shape, as seen from above, which is chosen among triangular, square, pentagonal, hexagonal, octagonal and nonagonal shapes. A shape including straight edges is often preferred due to its improved wear characteristics, which are believed to be due to the fact that dust laden air streams spinning inside the rotor, and having strong wearing characteristics, are obstructed by such straight edges.

A further object of the present invention is to provide a method of replacing a distributor plate of the rotor of a VSI-crusher, the method requiring less efforts than the prior art methods.

This object is achieved a method of mounting a replaceable distributor plate on a lower horizontal disc of a rotor of a vertical shaft impact crusher for protecting the lower horizontal disc, utilizing a distributor plate having at least two separate pieces, locating a first separate piece of the distributor plate on the lower horizontal disc, locating at least one further separate piece of the distributor plate on the lower horizontal disc adjacent to the first separate piece, such that separating lines, which separate the first separate piece and the at least one further separate piece from each other, will extend substantially from the center of the distributor plate to the periphery thereof, and fixing the first separate piece and the at least one further separate piece to the lower horizontal disc.

An advantage of this method is that it serves to make mounting of the distributor plate easier, since each separate piece has a lower weight than the complete distributor plate, and since each separate piece can be put in place via a smaller opening, compared to the complete distributor plate.

According to a preferred embodiment, the method further includes utilizing a distributor plate having three separate pieces, locating a third separate piece of the distributor plate on the lower horizontal disc adjacent to the first separate piece and the at least one further separate piece, each of the three separate pieces having a rhomboidal shape and forming together a hexagon, as seen from above.

Preferably, each of the separate pieces is moved into the interior of the rotor via at least one opening in a vertical rotor wall extending upwards from the lower horizontal disc. An advantage of this embodiment is that a minimum of dismantling is required when replacing the distributor plate.

A further object of the present invention is to provide a vertical shaft impact crusher, which is easier to maintain than those of the prior art.

This object is achieved by means of a rotor comprising a distributor plate as described hereinbefore.

According to a preferred embodiment, the rotor comprises at least one opening in a vertical rotor wall extending from the lower horizontal disc and upwards, a width of the at least one opening being larger than at least one width of each of the separate pieces, such that each of the separate pieces can be removed from, or entered into, the interior of the rotor via the at least one opening in the vertical rotor wall. An advantage of this embodiment is that replacing the distributor plate can be made without having to dismantle the upper horizontal disc, or any other major part of the rotor.

These and other aspects of the invention will be apparent from and elucidated with reference to the claims and the embodiments described hereafter.

BRIEF DESCRIPTION OF THE DRAWINGS

The invention will hereafter be described in more detail and with reference to the appended drawings.

DETAILED DESCRIPTION OF THE PREFERRED EMBODIMENTS

Figure 1:
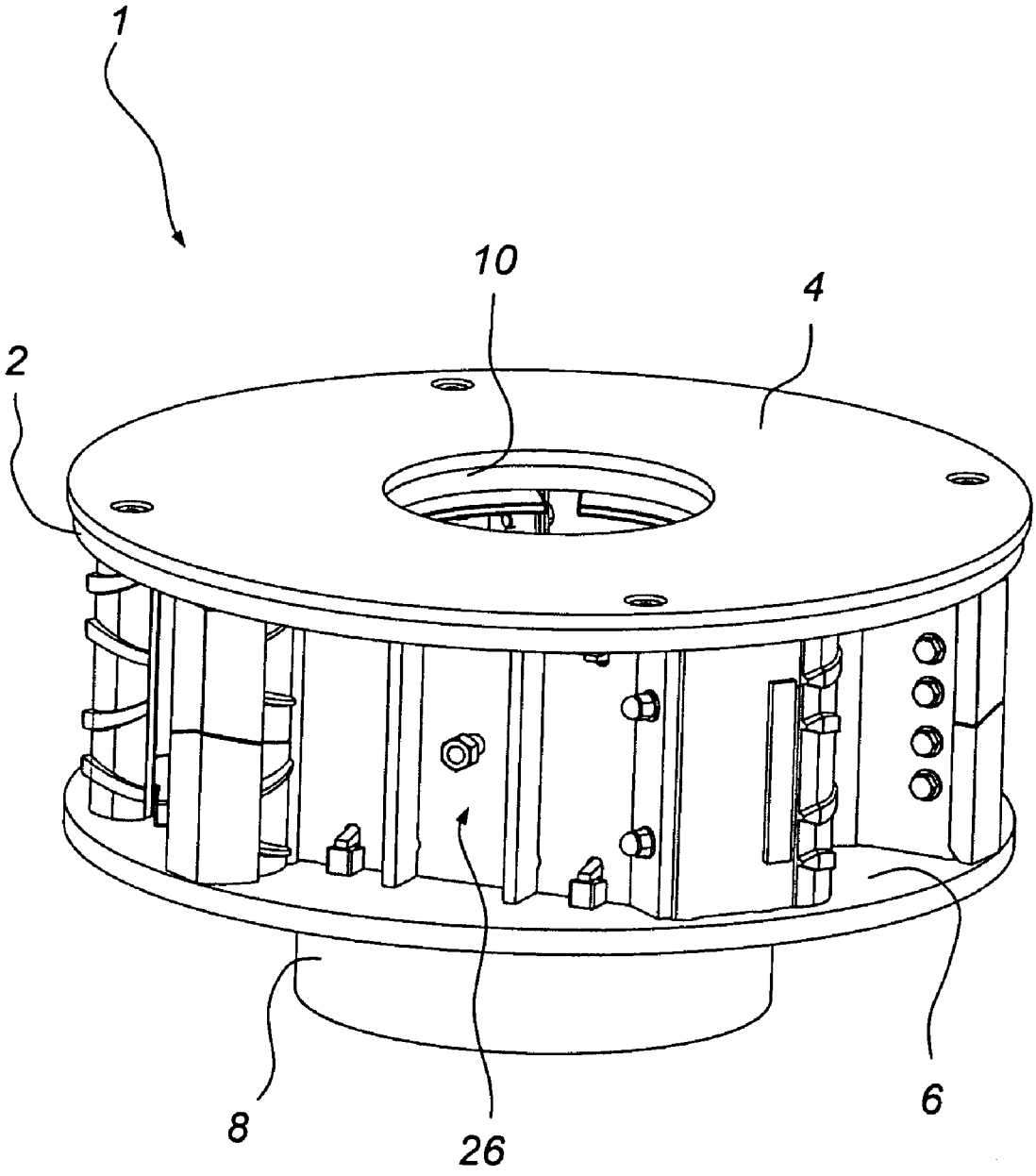
FIG. 1 is a three-dimensional view and shows a rotor for a VSI-crusher.

FIG. 1 shows a rotor 1 for use in a Vertical Shaft Impact crusher, i.e., a VSI-crusher. The rotor 1 has a roof in the form of an upper horizontal disc 2 having a top wear plate 4, and a floor in the form of a lower horizontal disc 6. The lower horizontal disc 6 has a hub 8, which is welded to the disc 6. The hub 8 is to be connected to a vertical shaft (not shown) for rotating the rotor 1 inside the housing of a VSI-crusher. The upper horizontal disc 2 has a central aperture 10 through which material to be crushed can be fed into the rotor 1. The upper horizontal disc 2 is protected from rocks impacting the rotor 1 from above by the top wear plate 4.

Figure 2:
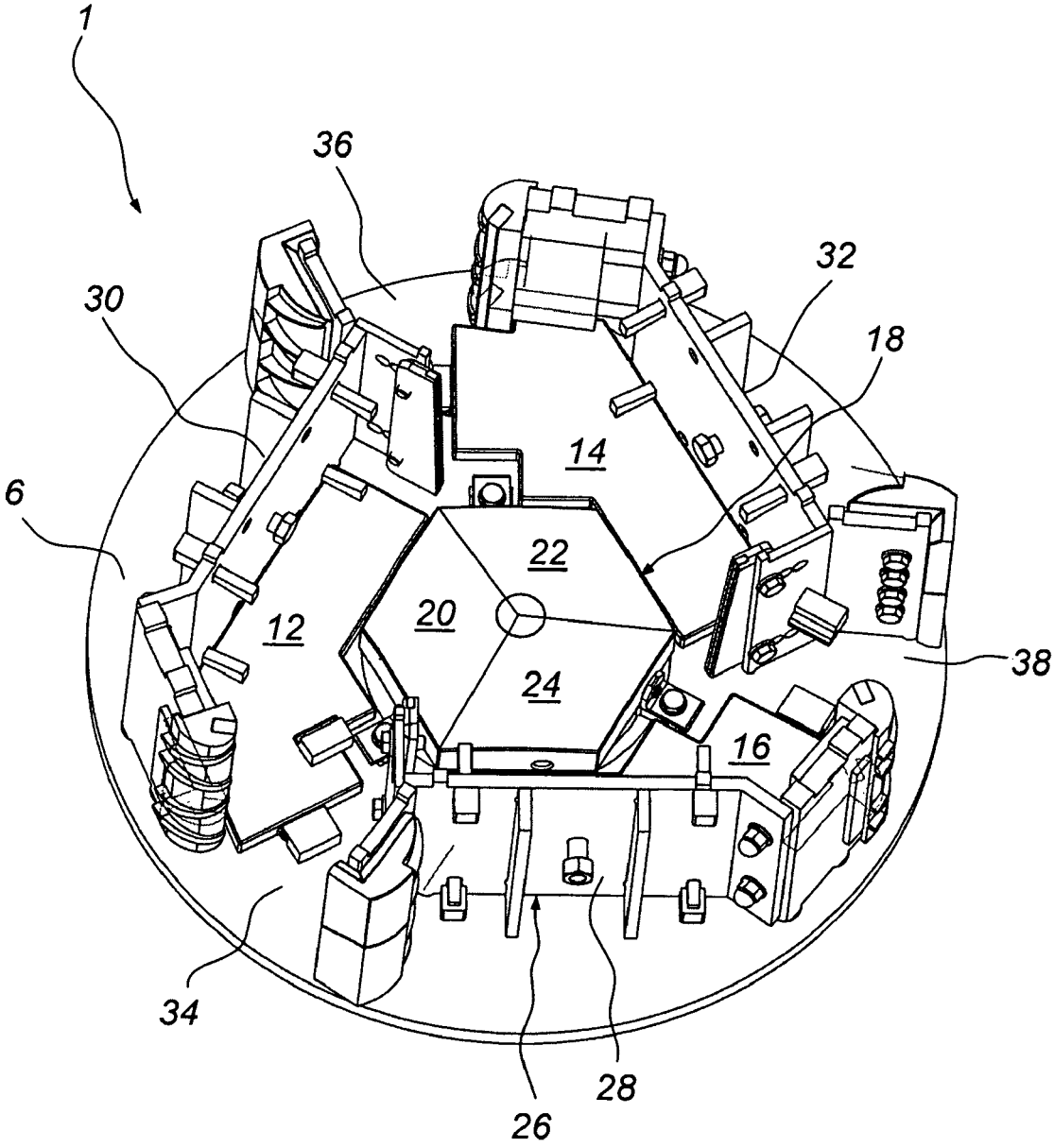
FIG. 2 is a three-dimensional view and shows the rotor of FIG. 1 with the upper disc removed.

As is better shown in FIG. 2, in which the upper horizontal disc 2 and the wear plate 4 are not shown for reasons of clarity, the lower horizontal disc 6 is protected from wear by three lower wear plates 12, 14 and 16. A distributor plate 18 is fastened to the center of the lower horizontal disc 6. The distributor plate 18 distributes the material that is fed via the aperture 10 in the upper horizontal disc 2 and protects the lower horizontal disc 6 from wear and impact damages caused by the material fed via the aperture 10. As will be described in more detail below, the distributor plate 18 comprises three separate pieces 20, 22, 24.

The upper and lower horizontal discs 2, 6 are separated by and held together by a vertical rotor wall 26, also shown in FIG. 1. The rotor wall 26 is separated into three wall segments 28, 30 and 32, as illustrated in FIG. 2. The gaps between the wall segments 28, 30, 32 define outflow openings 34, 36, 38, through which material may be ejected against a housing wall.

Figure 3:
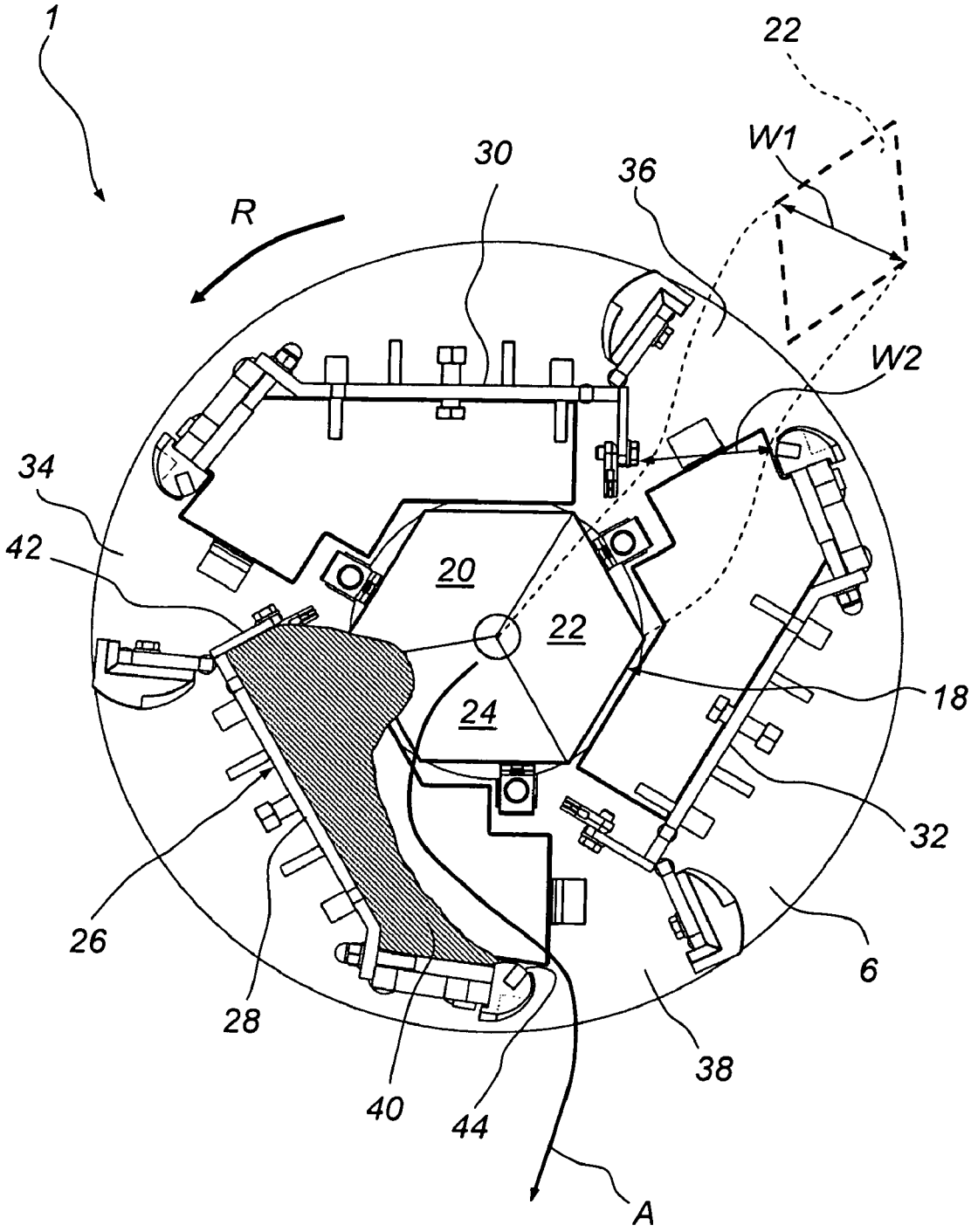
FIG. 3 shows the view of FIG. 2 as seen from above in a two-dimensional perspective.

FIG. 3 illustrates the rotor 1 as seen from above and in operation. The upper horizontal disc 2 and the top wear plate 4 are not shown in FIG. 3 for reasons of clarity. The arrow R indicates the rotational direction of the rotor 1 during operation of the VSI-crusher. During operation of the rotor 1, a bed of material 40 is built up inside the rotor 1 against each of the three wall segments 28, 30, 32. In FIG. 3 only the bed 40 located adjacent to the wall segment 28 is shown. The bed 40, which is made up of material that has been fed to the rotor 1 and then has been trapped inside it, extends from a rear support plate 42 to a wear tip 44. The bed 40 protects the wall segment 28 and the wear tip 44 from wear and provides a proper direction to the ejected material. The arrow A describes a typical passage of a piece of rock fed to the rotor 1 via the central aperture 10 and ejected via the outflow opening 38. It can be seen in FIG. 3 that the arrow A passes, at the distributor plate 18, mainly over the separate piece 24, and not over any separating lines separating the piece 24 from the other separate pieces 20, 22. Thus, the major portion of the flow of material, represented by the arrow A, will flow over the strongest part of the distributor plate 18, and not over the transitions between the separate pieces 20, 22, 24.

It is further illustrated in FIG. 3, by way of broken lines, how a separate piece 22 of the distributor plate 18 may be taken out of the rotor 1, during a maintenance stop, via the outflow opening 36 in the rotor wall 26. This is possible due to the fact that the small width W1 of the separate piece 22 is smaller than the width W2 of the opening 36. It will be appreciated that the separate piece 22 may, in some cases, have to be tilted to get it out of the opening 36. The fact that the distributor plate 18 can be removed from the interior of the rotor 1, or be inserted into the interior of the rotor 1, piece by piece via the openings 34, 36, 38 in the rotor wall 26, makes maintenance easier, since it is not necessary to remove the upper horizontal disc 2 and the top wear plate 4, both of which are only shown in FIG. 1, and/or a material feeding hopper, not shown, to maintain and/or replace one or several of the separate pieces 20, 22, 24 of the distributor plate 18.

Figure 4A:
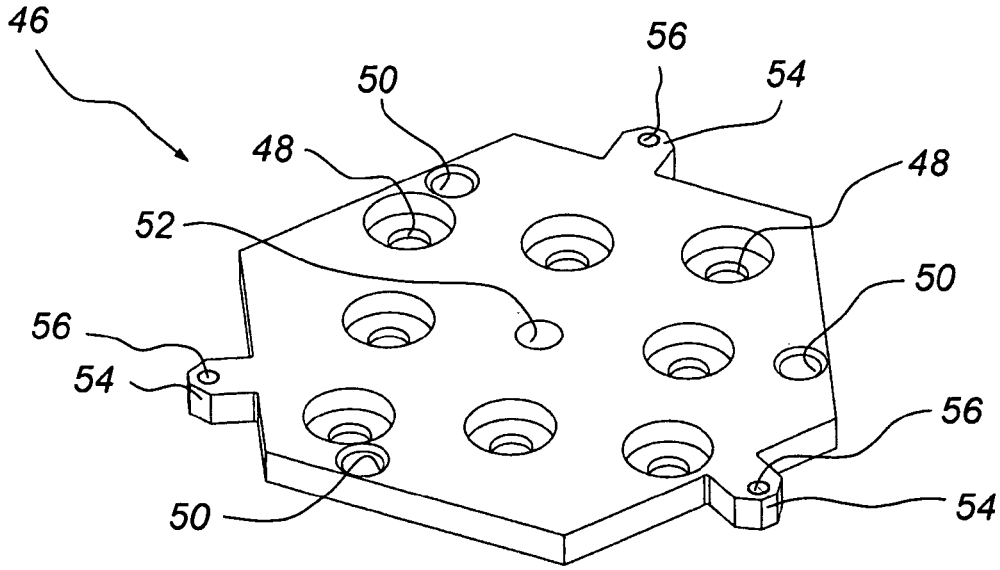
FIG. 4*a* is a three-dimensional view and illustrates a support plate for a distributor plate.

FIG. 4*a* illustrates a support plate 46, which is substantially hexagonal in shape, as seen from above. The support plate 46 is adapted for functioning as a support on which the distributor plate 18 can be mounted. The support plate 46 is provided with bolt holes 48 by means of which the support plate 46 is mounted on the hub 8, shown in FIG. 1, via the horizontal lower disc 6. The support plate 46 is normally not a wear part, and thus the support plate 46 is mounted on the horizontal lower disc 6 once and for all. Returning to FIG. 4*a*, the support plate 46 further comprises three mounting openings 50, each of which forms a second portion of a projection-opening arrangement, as will be illustrated below, and is adapted for cooperating with a corresponding projection on each of the separate pieces 20, 22, 24. A central bore 52 is adapted for receiving a central bolt, as will be described below. Furthermore, the support plate 46 comprises, evenly distributed around the periphery of the support plate 46, three brackets 54, each of which is provided with a threaded hole 56.

Figure 4B:
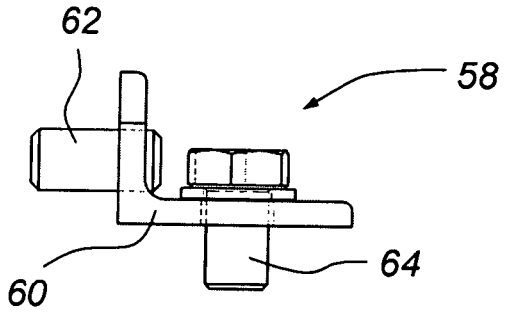
FIG. 4*b* is a side view and illustrates a fastening device.

FIG. 4*b* illustrates a fastening device 58. The fastening device 58 comprises an angle-iron 60, which holds, at its vertical leg, a pin 62. A bolt 64 extends through the horizontal leg of the angle-iron 60. The bolt 64 is adapted for being screwed into the threaded hole 56 of one of the brackets 54 of the support plate 46 to secure the fastening device 58 to the support plate 46.

Figure 5A:
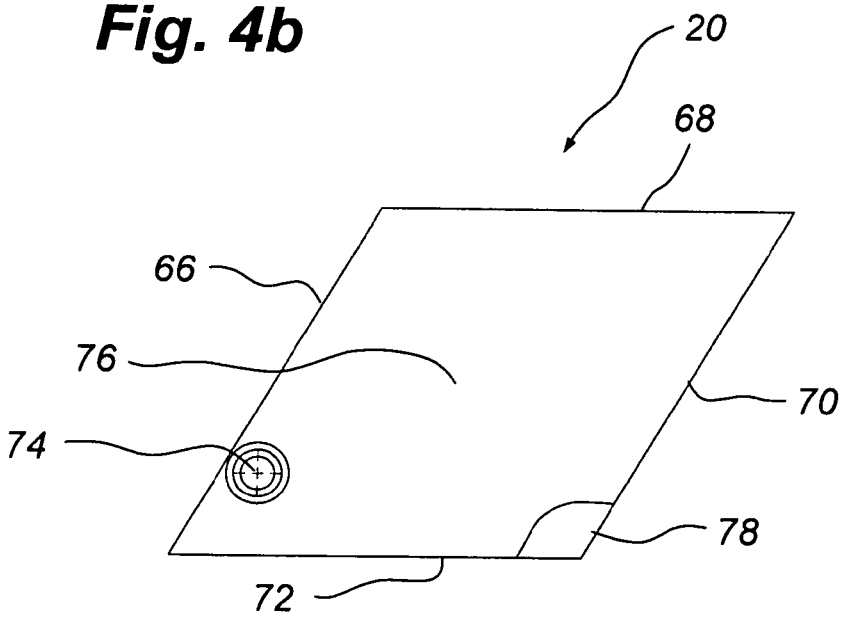
FIG. 5*a* is a plan view of a separate piece of a distributor plate, as seen from below.

FIG. 5*a* is a plan view of the separate piece 20, as seen from below. The separate piece 20 comprises a first outer face 66 and a second outer face 68. Furthermore, the separate piece 20 comprises a first inner face 70 and a second inner face 72. The four faces 66, 68, 70, 72 form a rhomb. A projection 74, which has a generally cylindrical shape and forms a first portion of the projection-opening arrangement, extends from a lower face 76 of the separate piece 20. As seen from FIG. 5*a*, the projection 74 extends from a position adjacent to the first outer face 66. A notch arrangement 78, which will be described in more detail below, is located at the position where the first and second inner faces 70, 72 meet.

Figure 5B:
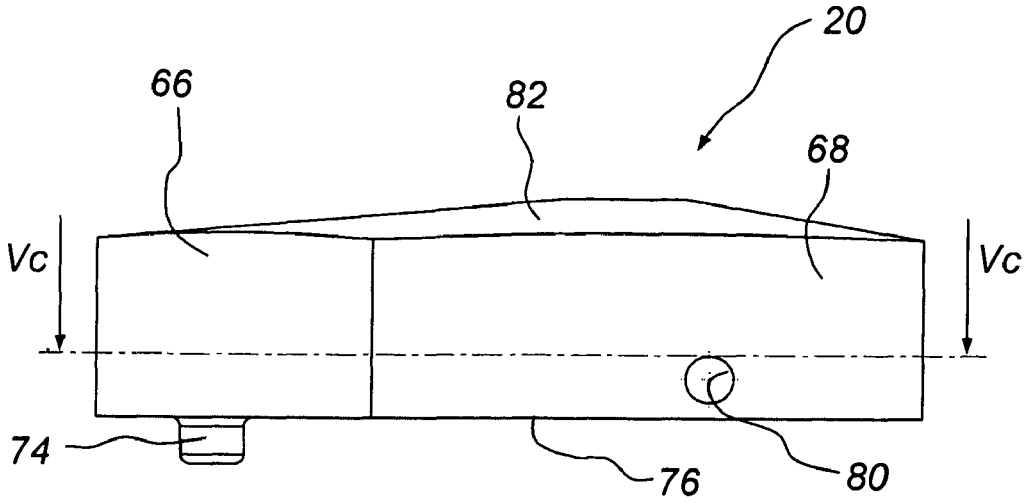
FIG. 5*b* is a plan view of the separate piece of the distributor plate, as seen from the outer side.

FIG. 5*b* is a side view and illustrates the two outer faces 66, 68 of the separate piece 20. FIG. 5*b* clearly illustrates that the projection 74 extends vertically downwards from the lower face 76. Furthermore, a pin hole 80 has been formed in the second outer face 68. The pin hole 80 is adapted for receiving the pin 62 of the fastening device 58, illustrated in FIG. 4*b*, when the separate piece 20 is mounted on the support plate 46. It can further be seen from FIG. 5*b* that an upper surface 82 is slightly sloping upward towards the inner faces of the separate piece 20. This slope is provided for improving the flow of material, as indicated by the arrow A of FIG. 3, from the center of the rotor 1 towards the outflow openings 34, 36, 38.

Figure 5C:
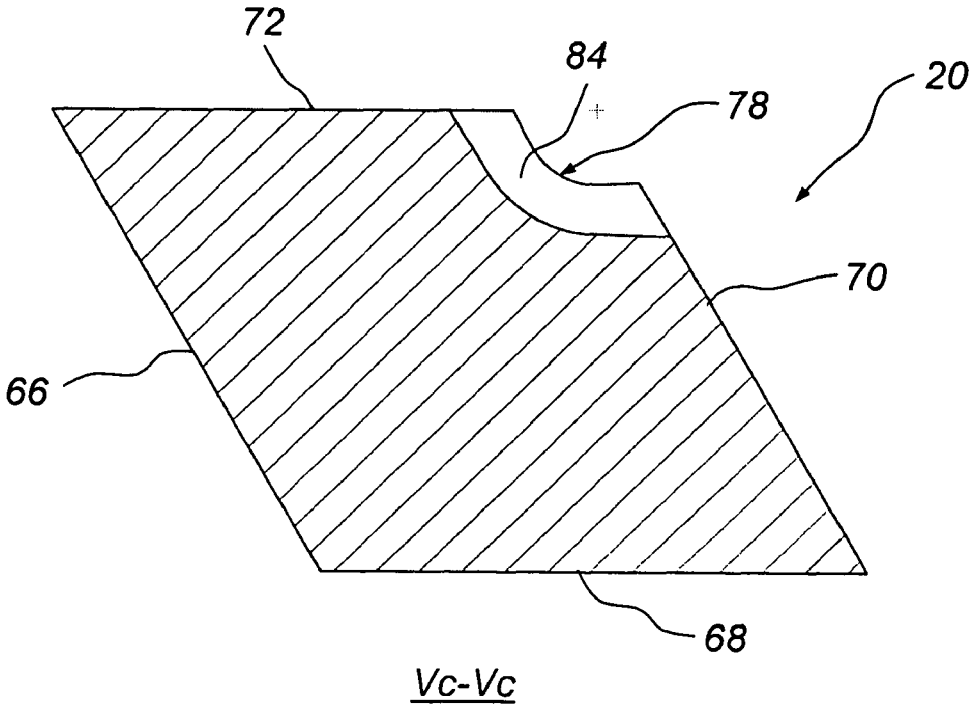
FIG. 5*c* is a cross-section of the separate piece, as seen along the line Vc-Vc of FIG. 5*b*.

FIG. 5*c* illustrates the separate piece 20 as seen in cross-section along the line Vc-Vc of FIG. 5*b*. As can be seen the notch arrangement 78 comprises a notch 84.

Figure 5D:
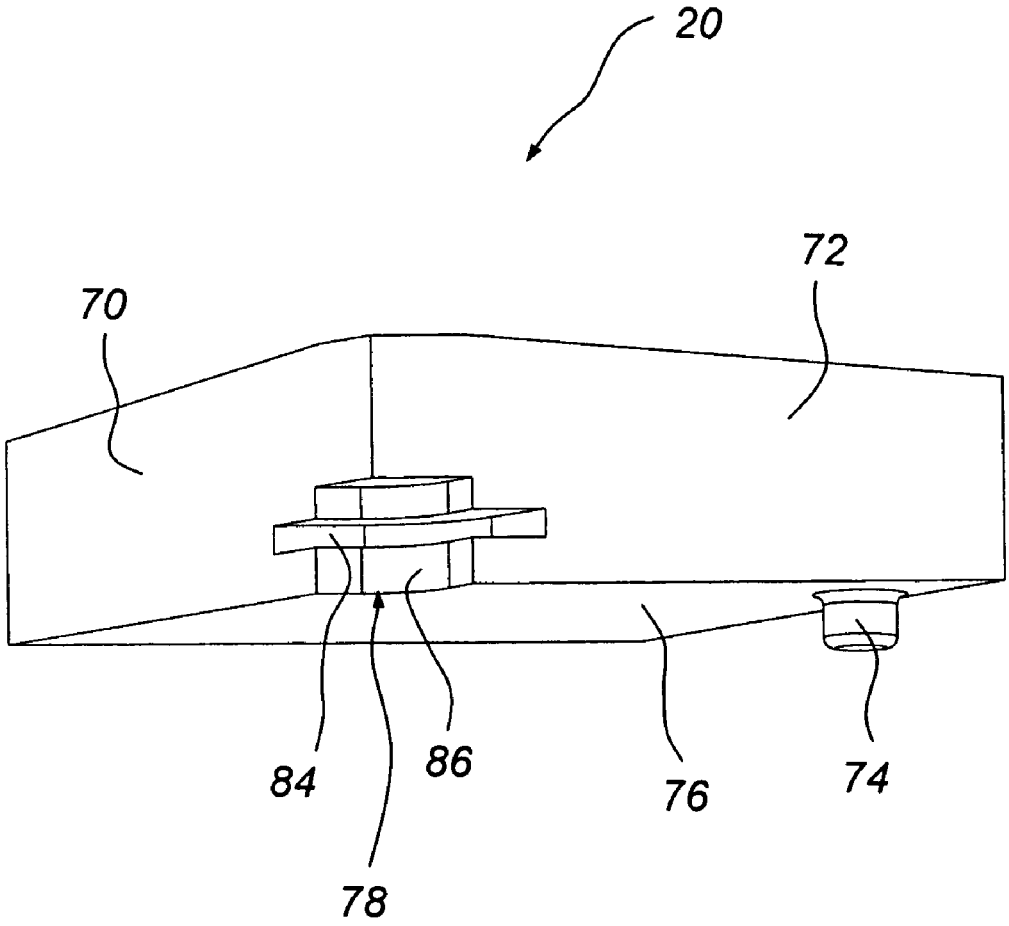
FIG. 5*d* is a three-dimensional view of the separate piece.

FIG. 5*d* illustrates the notch arrangement 78 more clearly. As is shown, the notch arrangement 78 comprises a recess 86 in which the notch 84 has been formed. The recess 86 extends from the lower face 76 and up to about 50% of the total thickness of the separate piece 20.

In FIGS. 5*a* to 5*d* the separate piece 20 of the distributor plate 18 has been described. However, the separate pieces 22 and 24 of the distributor plate 18 have identical design as the separate piece 20, such that one type of separate piece can be used in any location of the distributor plate 18.

Figure 6A:
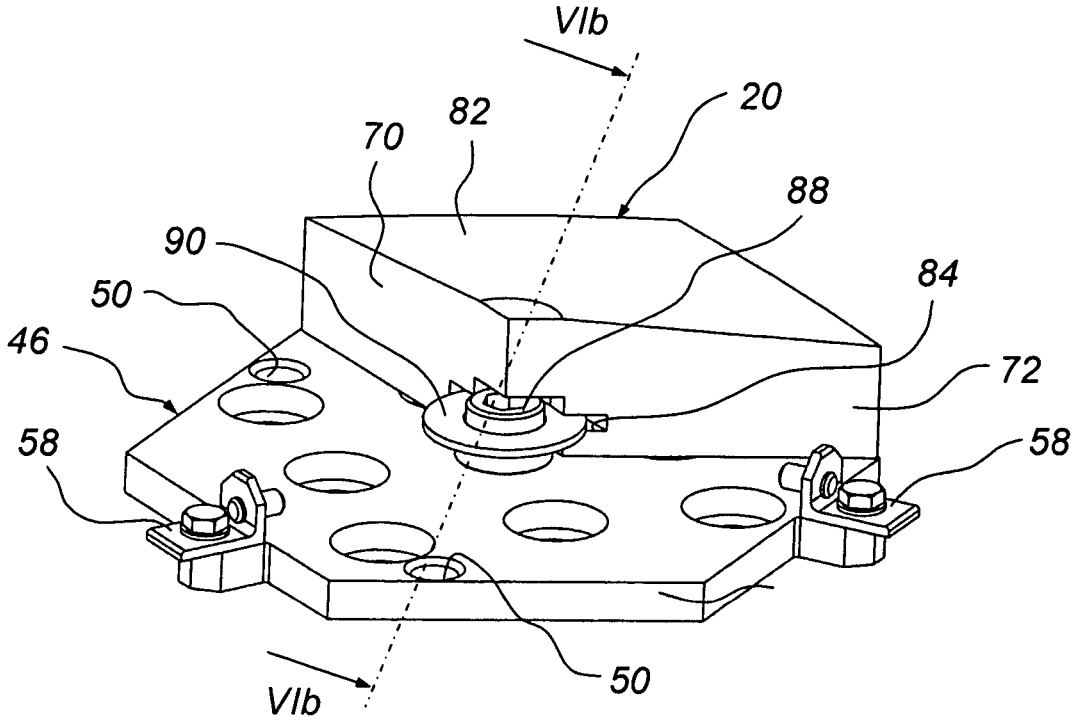
FIG. 6*a* is a three-dimensional view and illustrates the separate piece mounted on the support plate of FIG. 4*a*.
Figure 6B:
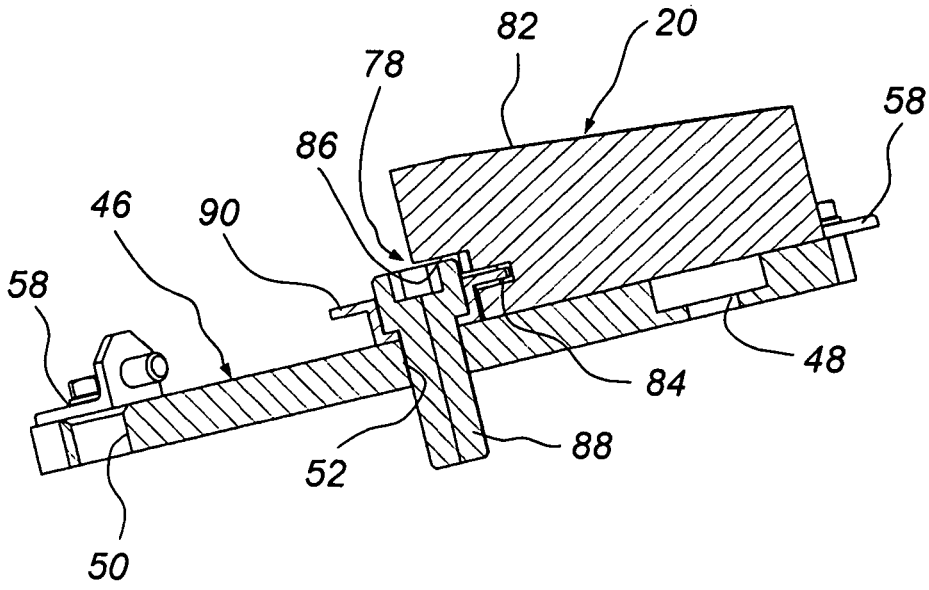
FIG. 6*b* is a cross-section and illustrates the separate piece as seen along the line VIb-VIb of FIG. 6*a*.

FIG. 6*a* and FIG. 6*b* illustrate the first separate piece 20 after being located on the support plate 46. It will be appreciated that the support plate 46 is fixed to the horizontal lower disc 6, which is not shown in FIG. 6*a*, FIG. 6*b*, FIG. 7*a* and FIG. 7*b* for clarity reasons. A central vertical bolt 88 has been mounted in the central bore 52 of the support plate 46. The vertical bolt 88 supports a bracket in the form of a substantially horizontal washer 90. As is shown in FIGS. 6*a* and 6*b*, the vertical bolt 88 is received in the recess 86 of the notch arrangement 78. Furthermore, the washer 90 is received in the notch 84 of the notch arrangement 78. Thus, the washer 90 locks the separate piece 20, as is best illustrated in FIG. 6*b*, such that the separate piece 20 cannot move in the vertical direction. The separate piece 20 has been located in such a position that the projection 74 extends into one of the mounting openings 50 of the support plate 46. Furthermore, a fastening device 58, hidden in FIG. 6*a*, has been mounted on the support plate 46 in such a manner that the pin 62, shown in FIG. 4*b*, of the fastening device 58 extends into the pin hole 80, shown in FIG. 5*b*, of the separate piece 20. The bolt 64, shown in FIG. 4*b*, of the fastening device 58 secures the fastening device 58 to the support plate 46. The projection 74 will prevent the sliding of the separate piece 20 over the support plate 46. Such function of the projection 74 will be supported by the fastening device 58, which will also lock the periphery of the separate piece 20 in the vertical direction. It will be appreciated that, although illustrated as mounted in FIG. 6*a* and FIG. 6*b*, the respective fastening device 58 is not mounted on the support plate 46 until after the respective separate piece 22, 24 has been located properly on the support plate 46.

Figure 7A:
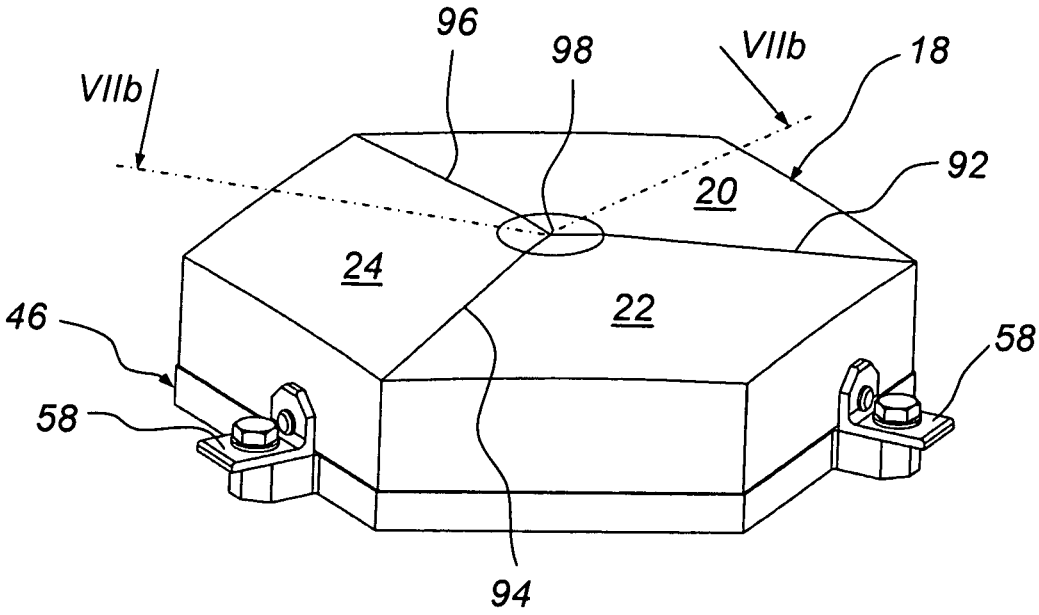
FIG. 7*a* is a three-dimensional view and illustrates a complete distributor plate.
Figure 7B:
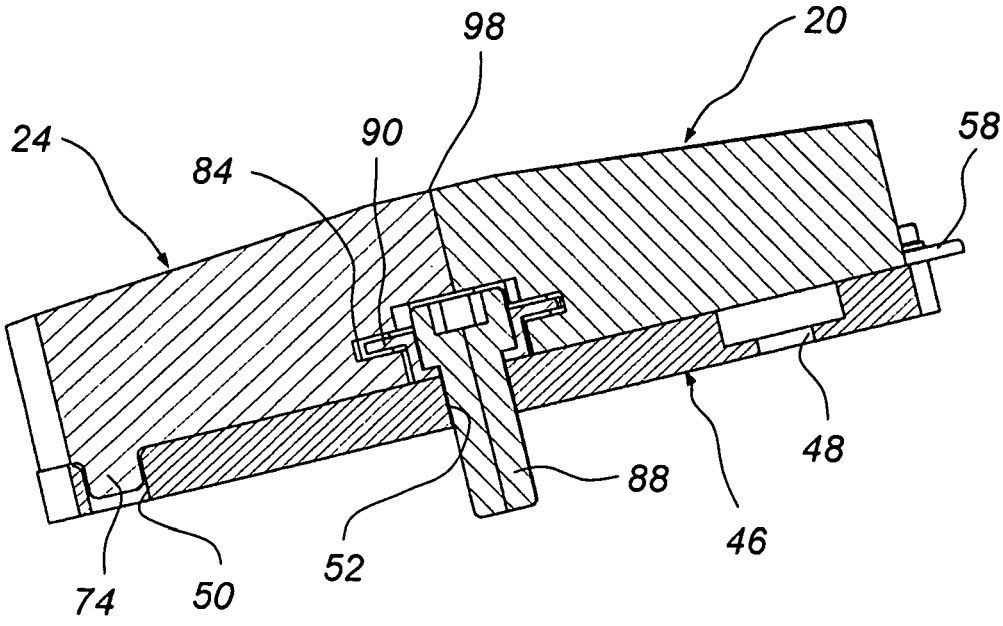
FIG. 7*b* is a cross-section and illustrates the distributor plate as seen along the line VIIb-VIIb of FIG. 7*a*.

FIGS. 7*a* and 7*b* illustrate the situation after all three separate pieces 20, 22, 24 of the distributor plate 18 have been mounted on the support plate 46. Each of the separate pieces 20, 22, 24 is held in place by means of its projection 74, the bolt 88 with its washer 90, and a respective fastening device 58. Each separate piece 20, 22, 24 is held in place in such a manner that it cannot move in relation to the other separate pieces or in relation to the support plate 46. As can be seen from FIG. 7*a*, the first separate piece 20 and the second separate piece 22 are separated from each other along a first separating line 92 which extends from the center 98 of the distributor plate 18 to the periphery thereof. The second separate piece 22 is separated from the third separate piece 24 along a second separating line 94, which is similar to the separating line 92, and the third separate piece 24 is separated from the first separate piece 20 along a third separating line 96, which is also similar to the separating line 92. The three separating lines 92, 94, 96 meet at the center 98 of the distributor plate 18.

It will be appreciated that numerous modifications of the embodiments described above are possible within the scope of the appended claims.

Above it has been described that the distributor plate is hexagonal and comprises three separate pieces. It will be appreciated that a hexagonal distributor plate could, as alternative, be divided in just two, identical, separate pieces, each constituting half of the distributor plate. Two separating lines, each extending from the center of such a distributor plate, would separate two such separate pieces from each other. Furthermore, it would also be possible to utilize a hexagonal distributor plate which is divided into six, identical, separate pieces. Furthermore, the distributor plate need not be hexagonal at all, it is also possible to design triangular, square, pentagonal, hexagonal, octagonal and nonagonal distributor plates, each comprising two or more separate pieces and being designed in accordance with the above described principles. It is also possible, but often less preferred, to design a distributor plate which has a circular design.

It has been described hereinbefore that the separate pieces 20, 22, 24 have identically the same design. This is often preferred, since mounting becomes easier when only one design of a separate piece is required. However, it is also possible to design a distributor plate comprising separate pieces of several different designs.

Above it has been described that the distributor plate 18 is mounted on a support plate 46 which is mounted on the lower horizontal disc 6. Hence, the distributor plate 18 is mounted indirectly on the lower horizontal disc 6. It will be appreciated that, as alternative, the distributor plate 18 can be mounted directly on the lower horizontal disc.

Above it has been mentioned that the separate pieces 20, 22, 24 of the distributor plate 18 are removed from the rotor 1 via the openings 34, 36, 38 in the rotor wall 26. It has also been mentioned that, if the width W2 of such openings is slightly too narrow, then the separate piece 20 could be tilted slightly before removing it via such an opening 34, 36, 38. Often the housing of a VSI-crusher is provided with an inspection door adjacent to the level of the openings 34, 36, 38, which makes it easy to remove separate pieces 20, 22, 24 from the crusher via such an inspection door. A further possibility is to remove one, or several, of the separate pieces 20, 22, 24 via the central aperture 10 formed in the upper horizontal disc 2.

Above it has been illustrated that a projection 74 on the separate piece 20 forms a first portion of a projection-opening arrangement, and that a mounting opening 50 on the support plate 46 forms a second portion of that projection-opening arrangement. It will be appreciated that other types of projection-opening arrangements could be used for holding a separate piece on the support plate. In accordance with an alternative embodiment an opening, forming a first portion of a projection-opening arrangement, could be formed in the lower face of a separate piece and could be adapted for cooperating with a projection, forming a second portion of that projection-opening arrangement and being formed at the upper surface of the support plate for cooperating with the opening in the separate piece. Hence, the separate piece could be provided with either a projection or an opening at its lower face, or a combination of both.

Although the present invention has been described in connection with preferred embodiments thereof, it will be appreciated by those skilled in the art that additions, deletions, modifications, and substitutions not specifically described may be made without department from the spirit and scope of the invention as defined in the appended claims.

The invention claimed is:

1. A replaceable distributor plate adapted for protecting a lower horizontal disc of a rotor of a vertical shaft impact crusher, wherein said distributor plate comprises at least two separate pieces, said at least two separate pieces being separated from each other along separating lines, as seen from above, each of which separating lines extending substantially from a center of the distributor plate to the periphery thereof, wherein each of said at least two separate pieces comprises, at its lower face, a first portion of a projection-opening arrangement, said first portion being adapted for cooperating with a second portion of said projection-opening arrangement, said second portion being associated with the lower horizontal disc.

2. A replaceable distributor plate adapted for protecting a lower horizontal disc of a rotor of a vertical shaft impact crusher, wherein said distributor plate comprises at least two separate pieces, said at least two separate pieces being separated from each other along separating lines, as seen from above, each of which separating lines extending substantially from a center of the distributor plate to the periphery thereof, wherein each of said at least two separate pieces comprises, adjacent to the center of the distributor plate, a notch adapted for cooperating with a bracket fixing the central portion of the distributor plate to the lower horizontal disc.

3. A replaceable distributor plate adapted for protecting a lower horizontal disc of a rotor of a vertical shaft impact crusher, wherein said distributor plate comprises at least two separate pieces, said at least two separate pieces being separated from each other along separating lines, as seen from above, each of which separating lines extending substantially from a center of the distributor plate to the periphery thereof, wherein said distributor plate has a shape, as seen from above, which is chosen from the group consisting of: triangular, square, pentagonal, hexagonal, octagonal and nonagonal.

4. The replaceable distributor plate according to claim 3, wherein said distributor plate has a hexagonal shape and comprises three separate pieces, each of which has a substantially rhomboidal shape, as seen from above.

5. A method of mounting a replaceable distributor plate on a lower horizontal disc of a rotor of a vertical shaft impact crusher for protecting said lower horizontal disc, comprising:

utilizing a distributor plate having at least two separate pieces, locating a first separate piece of said distributor plate on said lower horizontal disc, locating at least one further separate piece of said distributor plate on said lower horizontal disc adjacent to said first separate piece, such that separating lines, which separate said first separate piece and said at least one further separate piece from each other, will extend substantially from the center of the distributor plate to the periphery thereof, and fixing said first separate piece and said at least one further separate piece to said lower horizontal disc.

6. The method according to claim 5, further comprising utilizing a distributor plate having three separate pieces, and locating a third separate piece of said distributor plate on said lower horizontal disc adjacent to said first separate piece and said at least one further separate piece, each of said three separate pieces having a rhomboidal shape and forming together a hexagon, as seen from above.

7. The method according to claim 5, wherein each of said separate pieces is moved into the interior of said rotor via at least one opening in a vertical rotor wall extending upwards from said lower horizontal disc.

8. A vertical shaft impact crusher, comprising:

a rotor including a distributor plate for protecting a lower horizontal disc of a rotor of a vertical shaft impact crusher, wherein said distributor plate comprises at least two separate pieces, said at least two separate pieces being separated from each other along separating lines, as seen from above, each of which separating lines extending substantially from a center of the distributor plate to the periphery thereof; wherein said rotor comprises at least one opening in a vertical rotor wall extending from the lower horizontal disc and upwards, a width of said at least one opening being larger than at least one width of each of said separate pieces, such that each of said separate pieces can be removed from, or entered into, the interior of said rotor via said at least one opening in the vertical rotor wall.

* * * * *